US005425147A

United States Patent [19]

Supplee et al.

[11] Patent Number: 5,425,147

[45] Date of Patent: Jun. 20, 1995

[54] ADJUSTABLE AIR CUSHION MATERNITY MATTRESS

[76] Inventors: Ronald L. Supplee, Rte. 4, 1907 E. Martin Dr., Porter, Tex. 77365; Annalee Supplee, 20084 Sherwood Dr., Cleveland, Tex. 77327

[21] Appl. No.: 282,372

[22] Filed: Jul. 29, 1994

[51] Int. Cl.[6] ..... A47C 27/10

[52] U.S. Cl. ..... 5/453; 5/455; 5/930

[58] Field of Search ..... 5/455, 930, 631, 453

[56] References Cited

U.S. PATENT DOCUMENTS

| | | | |
|---|---|---|---|
| 3,303,518 | 2/1967 | Ingram | 5/456 |
| 3,840,920 | 10/1974 | Voelker | 5/348 |
| 3,918,110 | 11/1975 | Cantillo et al. | 5/455 |
| 4,051,566 | 10/1977 | Esquivel | 5/91 |
| 4,617,690 | 10/1986 | Grebe | 5/455 |
| 4,737,999 | 4/1988 | Halverson | 5/930 |
| 4,819,287 | 4/1989 | Halverson | 5/455 |
| 5,185,897 | 2/1993 | Van Laanen | 5/455 |
| 5,237,712 | 8/1993 | Ramsay | 5/464 |

FOREIGN PATENT DOCUMENTS

| | | | |
|---|---|---|---|
| 1456058 | 10/1966 | France | 5/453 |
| 1440193 | 6/1976 | United Kingdom | 5/455 |
| 0583024 | 12/1977 | U.S.S.R. | 4/455 |

*Primary Examiner*—Alexander Grosz

*Attorney, Agent, or Firm*—David L. Baker; Rhodes & Ascolillo

[57] ABSTRACT

A maternity mattress having three concentric inflatable cells where the cells are each independently adjustable and may be inflated or deflated by turning a selective valve and pressing the appropriate button on a pump switch.

1 Claim, 2 Drawing Sheets

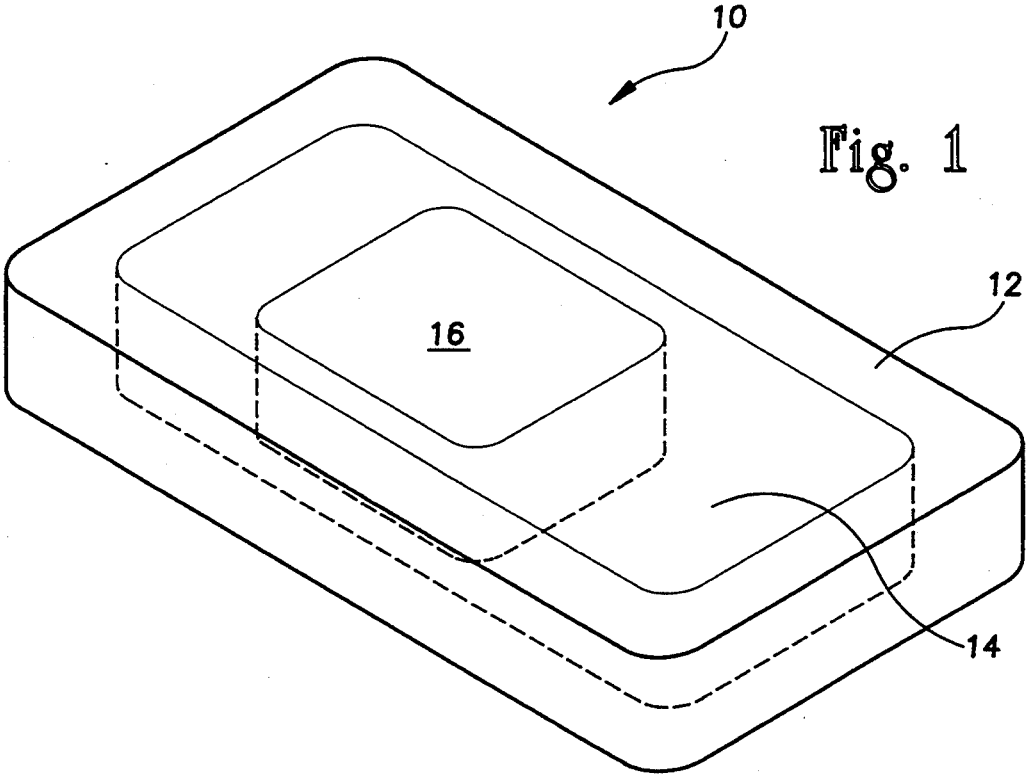
Fig. 1
Fig. 2
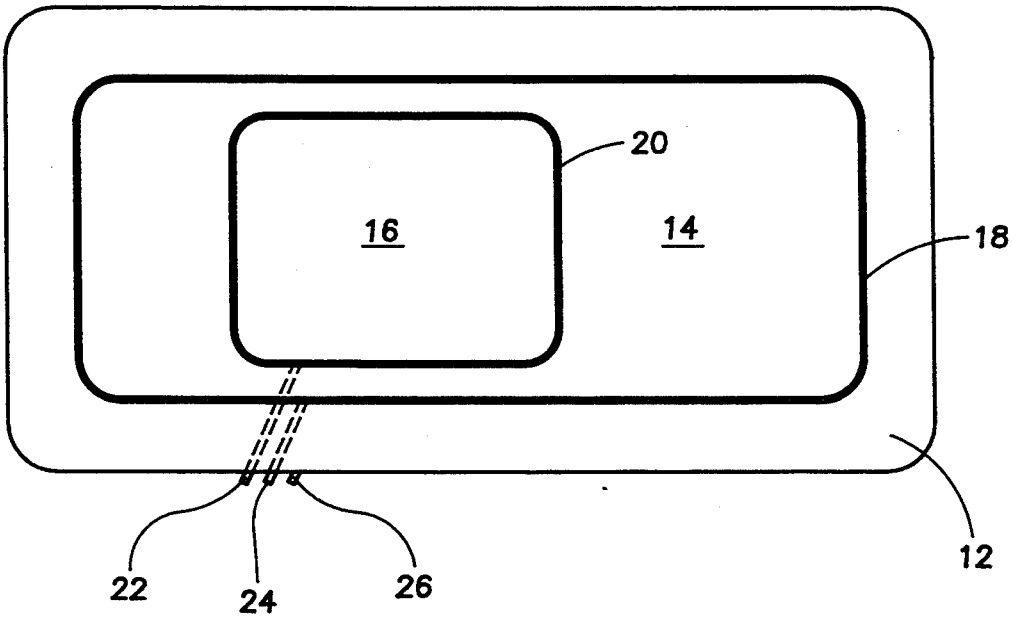

ADJUSTABLE AIR CUSHION MATERNITY MATTRESS

BACKGROUND OF THE INVENTION

1. Field of the Invention

This invention relates generally to furniture and bedding and more specifically to mattresses for pregnant or severely overweight people.

2. Description of the prior art

A common complaint made by women late in the term of their pregnancy is the inability to rest properly. Between the activity of the fetus and the inability to find a comfortable rest position the mother- to- be is frequently exhausted by the time the child is ready to be delivered. The effects of this exhaustion is carried on for many weeks, as after the delivery, the new mother is responsible for a 24 hour feeding schedule and other child care duties. It is therefore in the best interest of both mother and child that good prenatal rest be achieved.

A number of mattresses have been offered for the comfort of the expectant mother but none have achieved the universality of comfort achieved by the instant invention. Examples of these prior art mattresses are seen in the following U.S. Patents. U.S. Pat. No. 3,840,920 issued Oct. 15, 1974 to Voelker uses a non-resilient flowable material to conform to body shape, and U.S. Pat. No. 4,051,566 issued Oct. 4, 1977 issued to Esquivel shows a mattress with a mechanical adjustment cavity for the abdomen of a pregnant woman. More recently U.S. Pat. No. 4,819,287 issued Apr. 11,1989 to Halverson shows a conventional mattress with a cavity containing removable serial cushions. The patent issue to Van Laanen on Feb. 16, 1993, No. 5,185,897 shows an inflatable mattress with a cavity 6, panel 8 and a tie 12. The cavity may be inflated and reacts as shown in FIG. 4. A plug is provided for the cavity when not used for maternity purposes. The device lacks the multiple chambers and selective adjustability of the instant invention. U.S. Pat. No. 5,237,712 issued Aug. 24, 1993 to Ramsay shows a conventional mattress with a multi-chambered inflatable vessel in the mattress for accepting the woman's abdomen. The degree of inflation is adjustable via sealing valves 28. The instant invention is a substantial improvement over all these prior art devices.

SUMMARY OF THE INVENTION

This invention is a multi-celled air mattress particularly adapted for use by pregnant women and severely over-weight adults. The invention is characterized by the feature of instant adjustability where the user has merely to turn a valve and press a button and the firmness of the mattress and each of its chambers may be selectively changed. The system of the invention does not required that the user leave the mattress in order to make the changes, the controls would be located within easy reach and the adjustments could be made as often as desired for the maximum comfort of the user.

It is therefore an object of the invention to provide a new and improved mattress for pregnant women and severely overweight adults.

It is another object of the invention to provide a new and improved adjustable maternity mattress.

It is a further object of the invention to provide a new and improved maternity mattress constructed in multi-cellular form.

It is still another object of the invention to provide a new and improved mattress that may be used as a conventional or maternity mattress equally as well.

It is still a further object of the invention to provide a new and improved adjustable mattress that allows adjustments to be performed without disturbing the user.

It is another object of the invention to provide a new and improved mattress which has all of the advantages of prior art mattresses but none of the disadvantages.

It is another object of the invention to provide a new and improved air mattress that is of a durable and reliable construction.

It is another object of the invention to provide a new and improved maternity mattress that may be easily and efficiently manufactured and marketed.

These and other advantages, features and objects of the invention will become more apparent from the following description taken in connection with the illustrative embodiment in the accompanying drawings.

DESCRIPTION OF THE DRAWINGS

FIG. 1 is a perspective view of the invention.

FIG. 2 is plan view of the invention.

DETAILED DESCRIPTION OF A PREFERRED EMBODIMENT

Figure 3:
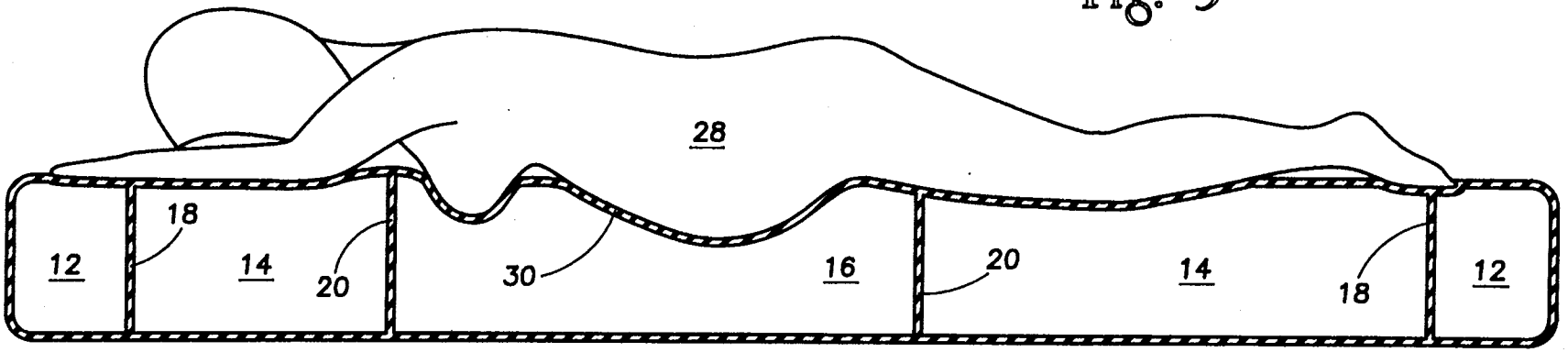
FIG. 3 is an environmental view of the invention showing the mattress in cross section.

Referring now to FIG. 1, the mattress of the invention is shown generally at 10. The outer cell is identified as 12, the intermediate cell as 14 and the inner cell as 16. The cell material may be a soft plastic or other material that is pliable over a range of temperatures, strong enough to bear the weight of at least one person and of a consistency that Will hold a gas such as air over a substantial period of time, several weeks for example.

While the mattress may be;constructed of individual cells secured by an enveloping membrane, the preferred embodiment utilizes a construction where the walls of the abutting cells are shared, thereby reducing cost of manufacture and weight of the device.

FIG. 2 shows outer cell 12 with common wall 18 between it and cell 14. Similarly, common wall 20 extends between cell 14 and cell 16. The volume and pressure of air in each cell is independently controlled via tubes 22,24 and 26. Cell 16 is positioned in the middle third of the mattress as measured along the longitudinal axis.

The environmental view of the invention of FIG. 3 shows a pregnant user 28 in the prone position with her abdomen resting on cell 16. It is possible to determine from the deflection of top wall 30 that the cell is at a less pressure then the abutting cells 12 and 14. Common shared walls are shown as 18 and 20. It is possible and contemplated by this invention that, when the pregnancy is over the pressure is increased in cell 16 and the mattress could be used as a conventional air mattress.

Although the invention is shown with one central cell, it is within the scope of the invention to provide two central cells to accommodate two occupants. Each central cell would have its own comfort control with one of the controls regulating the pressure and volume in the two outer cells.

Figure 4:
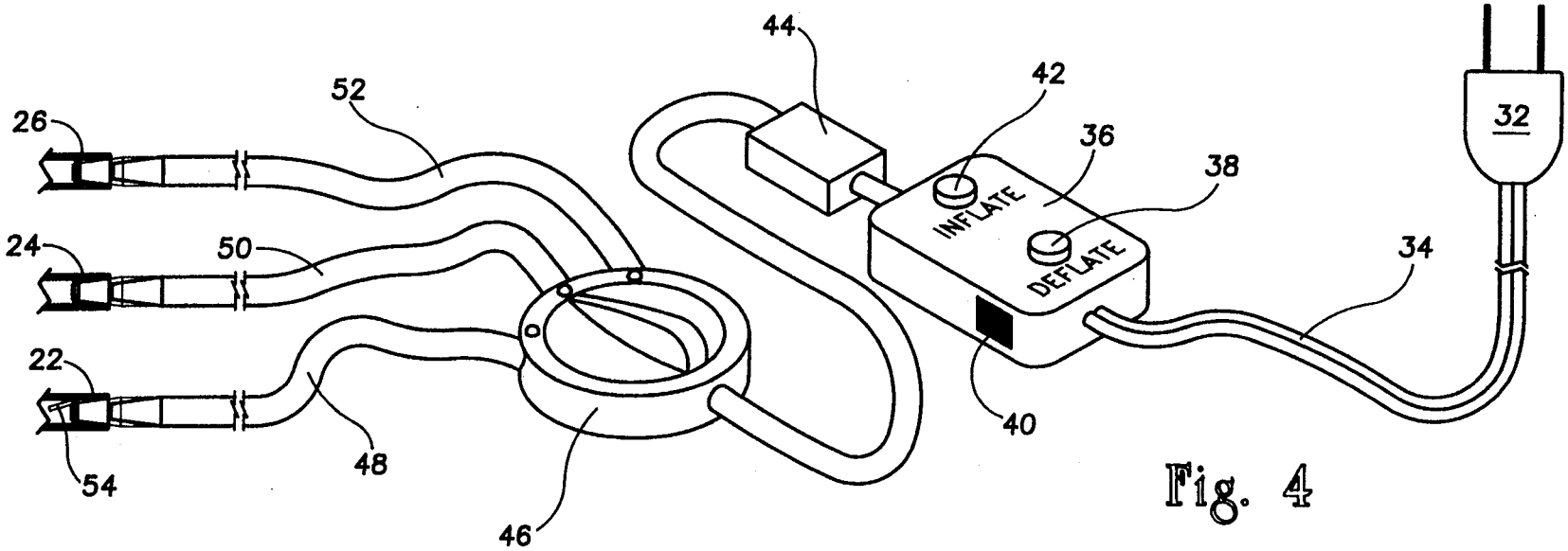
FIG. 4 is a schematic view of the system of the invention.

FIG. 4 shows the system for inflation and deflation. A plug 32 is adapted to fit the ordinary electrical user outlet. Ordinary household electrical cord 34 runs from the plug to the pressure control switch 36. A deflate switch 38 may be electrical or mechanical and exhausts air through vent 40 when depressed. Inflate switch 42 activates electric pump 44 which sends air at low volume and low pressure to three way valve 46. The valve will direct the air to the selected cell via hoses 48, 50 and 52 which are connected to the cell inlet tubes 22,24 and 26 respectively. Each inlet tube is equipped with a one way valve 54 that will stop air from escaping from the cell in the event the hose becomes dislodged. In the event of a dual cell system the second central cell will not have the three way valve but rather a pump with inflate and deflate switches.

It should be understood, of course, that the foregoing disclosure relates to only a preferred environment of the invention and that numerous modifications or alterations may be made therein Without departing from the spirit and scope of the invention as set forth in the appended claims.

What is claimed is:

1. An adjustable air cushion maternity mattress comprising: a first inflatable cell, having walls defining a cavity; a second inflatable cell within the cavity of the first cell and sharing the cavity defining walls of the first cell, said second cell, having walls defining a cavity; a third inflatable cell within the cavity of the second cell, said third inflatable cell sharing the cavity defining walls of the second cell; said first second and third cells defining an inflatable mattress of a sufficient size to adjustably support an adult user; electrically powered air pump means connected to the mattress for inflating each cell; pneumatic release valve means connected to the mattress for deflating each cell; controller means for operating the air pump means and release valve means, and a single three way valve means connected between the said pump means and the said first, second and third cells for selectively engaging the inflating and deflating means to each said cell.

* * * * *